US008937585B2

(12) United States Patent
Jang

(10) Patent No.: US 8,937,585 B2
(45) Date of Patent: Jan. 20, 2015

(54) PIXEL AND ORGANIC LIGHT EMITTING DISPLAY USING THE SAME

(75) Inventor: Hwan-Soo Jang, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 312 days.

(21) Appl. No.: 12/980,634

(22) Filed: Dec. 29, 2010

(65) Prior Publication Data

US 2012/0026143 A1 Feb. 2, 2012

(30) Foreign Application Priority Data

Jul. 27, 2010 (KR) ..... 10-2010-0072432

(51) Int. Cl.

| | |
|---|---|
| ***G09G 3/32*** | (2006.01) |
| ***G09G 3/36*** | (2006.01) |
| ***G09G 5/00*** | (2006.01) |
| *G09G 3/30* | (2006.01) |

(52) U.S. Cl.

CPC ... *G09G 5/00* (2013.01); *G09G 3/30* (2013.01)
USPC ..... 345/82; 345/83; 345/87

(58) Field of Classification Search

USPC ..... 345/204, 82, 83, 87–104
See application file for complete search history.

(56) References Cited

U.S. PATENT DOCUMENTS

| | | | | |
|---|---|---|---|---|
| 6,919,871 | B2 * | 7/2005 | Kwon | 345/92 |
| 2006/0139253 | A1 * | 6/2006 | Choi et al. | 345/76 |
| 2009/0021539 | A1 * | 1/2009 | Kimura | 345/690 |

FOREIGN PATENT DOCUMENTS

| | | | |
|---|---|---|---|
| KR | 10-0581809 | | 5/2006 |
| KR | 10-2007-0083072 | A | 8/2007 |
| KR | 10-0833760 | | 5/2008 |
| KR | 1020070004860 | A * | 5/2008 |

* cited by examiner

*Primary Examiner* — Ilana Spar
(74) *Attorney, Agent, or Firm* — Christie, Parker & Hale, LLP

(57) ABSTRACT

A pixel capable of displaying an image with uniform brightness, the pixel including an organic light emitting diode, a first transistor to control an amount of current supplied from a first power source coupled to a first electrode to the OLED, a second transistor coupled between a data line and a third node to be turned on when a first scan signal is supplied to a first scan line, a first capacitor coupled between the gate electrode of the first transistor and a second node, a sixth transistor coupled between the second node and the third node to be turned off when an emission control signal is supplied to an emission control line, a second capacitor coupled between the third node and the first power source, a fifth transistor coupled between the first power source and the second node to be turned on when the first scan signal is supplied to the first scan line, and a fourth transistor coupled between a second electrode of the first transistor and the data line to be turned on when a second scan signal is supplied to a second scan line.

3 Claims, 5 Drawing Sheets

PIXEL AND ORGANIC LIGHT EMITTING DISPLAY USING THE SAME

CROSS-REFERENCE TO RELATED APPLICATION

This application claims the benefit of Korean Application No. 10-2010-0072432, filed Jul. 27, 2010, in the Korean Intellectual Property Office, the disclosure of which is incorporated herein by reference.

BACKGROUND

1. Field

An aspect of the present invention relates to a pixel and an organic light emitting display, and more particularly, to a pixel capable of displaying an image with uniform brightness and an organic light emitting display using the same.

2. Description of the Related Art

Recently, various flat panel displays (FPD) having reduced weight and volume as compared to cathode ray tubes (CRT) have been developed. The FPDs include liquid crystal displays (LCD), field emission displays (FED), plasma display panels (PDP), and organic light emitting displays.

Among the FPDs, the organic light emitting displays display images using organic light emitting diodes (OLED) that generate light by re-combination of electrons and holes. The organic light emitting display has high response speed and is driven with low power consumption.

FIG. 1 is a circuit diagram illustrating a pixel of a conventional organic light emitting display. Referring to FIG. 1, a pixel 4 of the conventional organic light emitting display includes an organic light emitting diode OLED and a pixel circuit 2 coupled to a data line Dm and a scan line Sn to control the OLED.

The anode electrode of the OLED is coupled to the pixel circuit 2 and the cathode electrode of the OLED is coupled to a second power source ELVSS. The OLED emits light with the brightness corresponding to the current supplied from the pixel circuit 2.

The pixel circuit 2 controls the amount of current supplied to the OLED to correspond to a data signal supplied to the data line Dm when a scan signal is supplied to the scan line Sn. Therefore, the pixel circuit 2 includes a second transistor M2 coupled between a first power source ELVDD and the OLED, a first transistor M1 coupled between the second transistor M2, the data line Dm, and the scan line Sn, and a storage capacitor Cst coupled between the gate electrode and the first electrode of the second transistor M2.

The gate electrode of the first transistor M1 is coupled to the scan line Sn and the first electrode of the first transistor M1 is coupled to the data line Dm. The second electrode of the first transistor M1 is coupled to one terminal of the storage capacitor Cst. Here, the first electrode is set as one of a source electrode and a drain electrode and the second electrode is set as an electrode different from the first electrode. For example, when the first electrode is set as the source electrode, the second electrode is set as the drain electrode. The first transistor M1 coupled to the scan line Sn and the data line Dm is turned on when the scan signal is supplied from the scan line Sn to the gate electrode of the first transistor M1 to supply the data signal supplied from the data line Dm to the storage capacitor Cst. At this time, the storage capacitor Cst charges with the voltage corresponding to the data signal.

The gate electrode of the second transistor M2 is coupled to one end of the storage capacitor Cst and the first electrode of the second transistor M2 is coupled to the other terminal of the storage capacitor Cst and the first power source ELVDD. The second electrode of the second transistor M2 is connected to the anode electrode of the OLED. The second transistor M2 controls the amount of current that flows from the first power source ELVDD to the second power source ELVSS via the OLED to correspond to the value of the voltage stored in the storage capacitor Cst. At this time, the OLED emits the light corresponding to the amount of current supplied from the second transistor M2.

However, the pixel 4 of the conventional organic light emitting display cannot display an image with uniform brightness. In detail, the threshold voltage of the second transistor M2 (a driving transistor) included in the pixel 4 is set to vary with the pixel 4 due to process deviation. When the threshold voltage of the driving transistor is set to vary, although data signals corresponding to the same gray level are supplied to the plurality of pixels 4, light components with different brightness components are generated due to a difference in the threshold voltage of the driving transistor.

In order to solve the above and/or other problems, a structure of additionally forming transistors in the pixels 4 is suggested in order to compensate for the threshold voltage of the driving transistor. For example, in the Korean Patent Publication No. 2007-0083072, the threshold voltage of the driving transistor is compensated for using the six transistors included in each of the pixels 4.

However, in the Korean Patent Publication No. 2007-0083072, since one pixel is coupled to a plurality of wiring lines Sn, Sn−1, En, Vint, and Dm, complexity of a process increases and reliability deteriorates.

SUMMARY

Accordingly, an aspect of the present invention has been made to provide a pixel capable of minimizing the number of wiring lines coupled to the pixel and capable of displaying an image with uniform brightness and an organic light emitting display using the same.

In order to achieve the foregoing and/or other aspects of the present invention, there is provided a pixel including an organic light emitting diode, a first transistor for controlling an amount of current supplied from a first power source coupled to a first electrode to the OLED, a second transistor coupled between a data line and a third node to be turned on when a first scan signal is supplied to a first scan line, a first capacitor coupled between the gate electrode of the first transistor and a second node, a sixth transistor coupled between the second node and the third node, the sixth transistor to be turned off when an emission control signal is supplied to an emission control line, a second capacitor coupled between the third node and the first power source, a fifth transistor coupled between the first power source and the second node, the fifth transistor to be turned on when the first scan signal is supplied to the first scan line, and a fourth transistor coupled between a second electrode of the first transistor and the data line, the fourth transistor to be turned on when a second scan signal is supplied to a second scan line.

According to another aspect of the present invention, the second transistor is simultaneously turned on with the fourth transistor and maintains a turn on state for a longer time than the fourth transistor. The turn on time of the sixth transistor does not overlap with the turn on time of the second transistor and the fourth transistor. The pixel further includes a third transistor coupled between the second electrode and the gate electrode of the first transistor, the third transistor to be turned on when the first scan signal is supplied to the first scan line and a seventh transistor coupled between the second electrode of the first transistor and the OLED to be turned off when the emission control signal is supplied to the emission control line.

According to another aspect of the present invention, there is provided an organic light emitting display, including a scan driver to drive first scan lines, second scan lines, and emission control lines, a data driver to drive data lines, and pixels positioned at intersections of the first scan lines and the data lines. Each of pixels positioned on an ith (i is a natural number) horizontal line includes an OLED, a first transistor to control an amount of current supplied from a first power source coupled to a first electrode to the OLED, a second transistor coupled between the data line and a third node to be turned on when a first scan signal is supplied to an i1st scan line, a first capacitor coupled between a gate electrode and a second node of the first transistor, a sixth transistor coupled between the second node and the third node to be turned off when an emission control signal is supplied to an ith emission control line, a second capacitor coupled between the third node and the first power source, a fifth transistor coupled between the first power source and the second node to be turned on when the first scan signal is supplied to the ith first scan line, and a fourth transistor coupled between a second electrode of the first transistor and the data line to be turned on when a second scan signal is supplied to an i2nd scan line.

According to another aspect of the present invention, the scan driver simultaneously supplies the second scan signal to the i2nd scan line with the first scan signal supplied to the i1st scan line and supplies the first scan signal for a longer time than the second scan signal. The scan driver supplies the emission control signal to the ith emission control line to overlap the first scan signal supplied to the i1st scan line. The data driver supplies an initial power source to the data line in a period when a second scan signal is supplied to the i2nd scan line and supplies a data signal to the data line in a period when supply of a second scan signal to the i2nd scan line is stopped and a first scan signal is supplied to the i1st scan line.

According to an aspect of the present invention, the organic light emitting display further includes a demultiplexer coupled to output lines of the data driver to transmit j (j is a natural number) data signals supplied to the output lines to j data lines. The demultiplexer includes j switching elements and the j switching elements are simultaneously turned on in a period when the first scan signal and the second scan signal are simultaneously supplied. The demultiplexer includes the j switching elements and the j switching elements are sequentially turned on in a period when the first scan signal is supplied after supply of the second scan signal is stopped.

According to another aspect of the present invention, since the initial power source is supplied using the data lines, the wiring line coupled to the initial power source may be removed. In addition, when the data signals are supplied to the pixels using a demultiplexer, the threshold voltage of the driving transistor may be compensated for a time longer than a time for which the data signals are supplied to the pixels.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
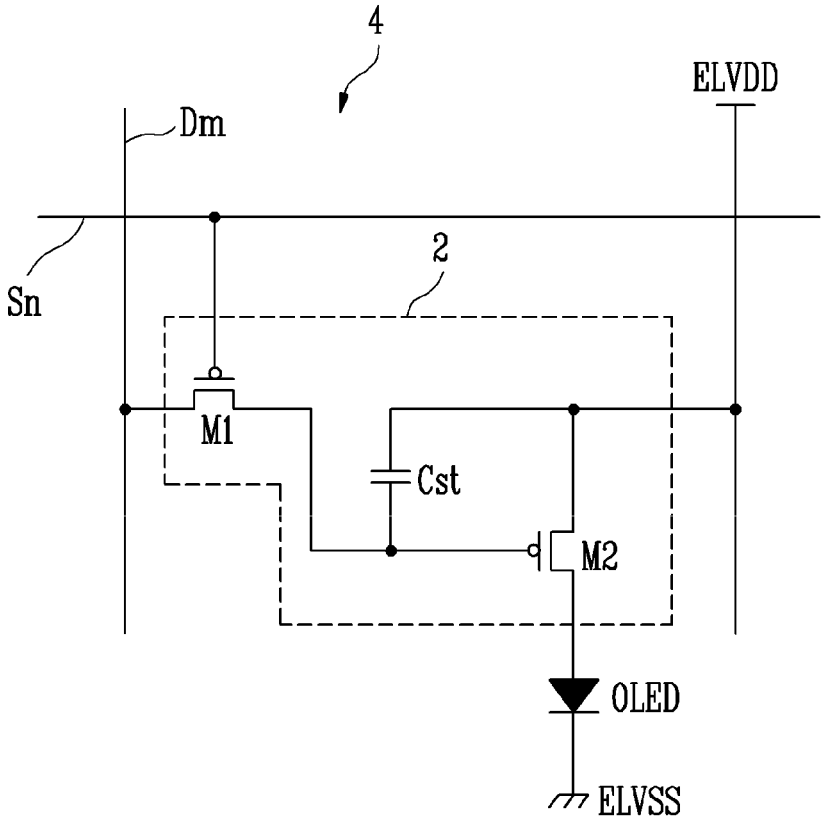
FIG. 1 is a circuit diagram illustrating a conventional pixel circuit.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
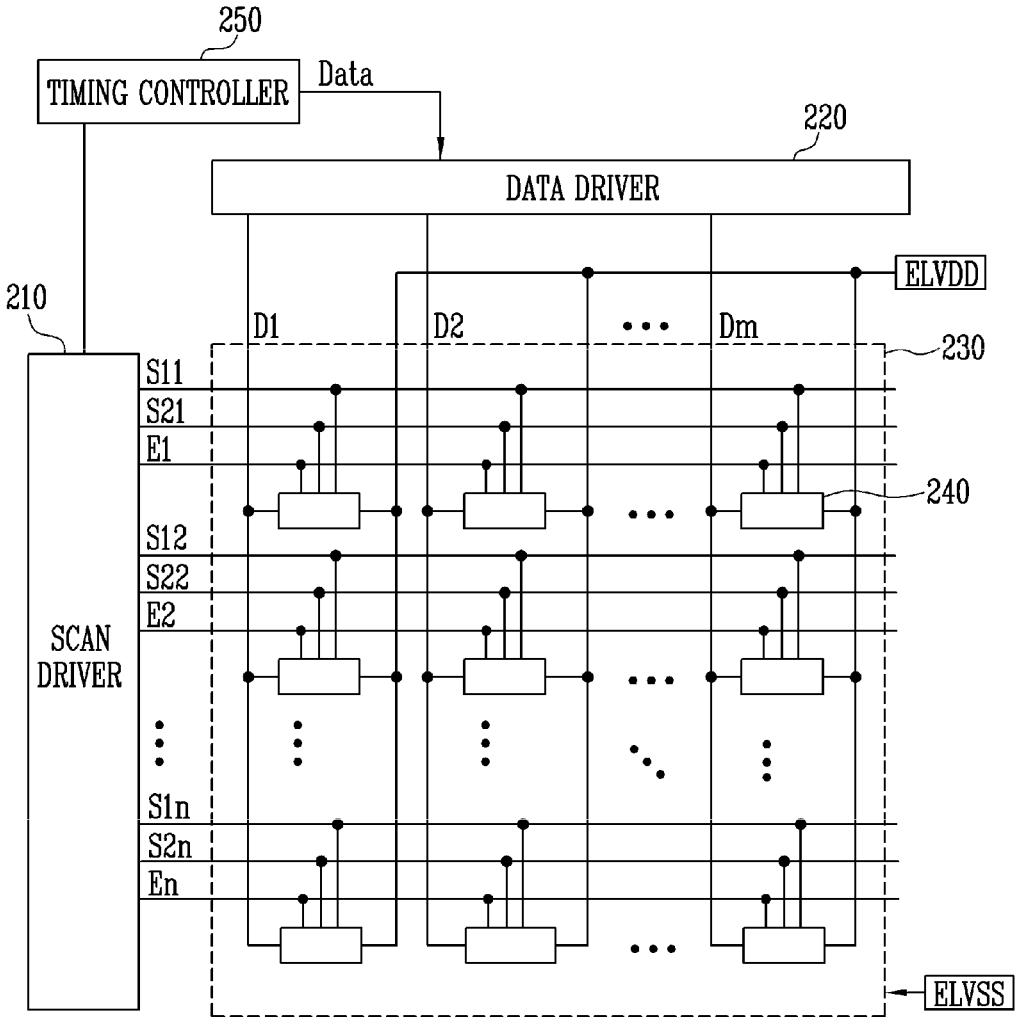
FIG. 2 is a view illustrating an organic light emitting display according to an embodiment of the present invention.

FIG. 2 is a view illustrating an organic light emitting display according to an embodiment of the present invention. Referring to FIG. 2, the organic light emitting display according to the embodiment of the present invention includes a pixel unit 230 including a plurality of pixels 240 coupled to first scan lines S11 to S1*n*, second scan lines S21 to S2*n*, emission control lines E1 to En, and data lines D1 to Dm, a scan driver 210 for driving the first scan lines S11 to S1*n*, the second scan lines S21 to S2*n*, and the emission control lines E1 to En, a data driver 220 for driving the data lines D1 to Dm, and a timing controller 250 for controlling the scan driver 210 and the data driver 220.

The scan driver 210 sequentially supplies first scan signals to the first scan lines S11 to S1*n* and sequentially supplies second scan signals to the second scan lines S21 to S2*n*. Here, the first scan signal supplied to an i1st (i is a natural number) scan line S1*i* is simultaneously supplied to the second scan signal supplied to the i2nd scan line S2*i* for a time (that is, set as a larger width) longer than the second scan signal.

In addition, the scan driver 210 sequentially supplies the emission control signals to the emission control lines E1 to En. Here, the emission control signal supplied to the ith emission control line Ei is supplied to overlap the first scan signal supplied to the first scan line Si.

The data driver 220 continuously supplies an initial power source and data signals to the data lines D1 to Dm. For example, the data driver 220 supplies the initial power source to the data lines D1 to Dm in a period when the first scan signal and the second scan signal are supplied to overlap each other and supplies the data signals to the data lines D1 to Dm in a period when only the first scan signal is supplied.

The timing controller 250 controls the scan driver 210 and the data driver 220 to correspond to synchronizing signals supplied from the outside. Then, the timing controller 250 supplies data Data supplied from the outside to the data driver 220.

The pixel unit 230 receives a first power source ELVDD and a second power source ELVSS from the outside to supply the first power source ELVDD and the second power source ELVSS to the pixels 240. The pixels 240 that receive the first power source ELVDD and the second power source ELVSS generate light with predetermined brightness while controlling the amount of current that flows from the first power source ELVDD to the second power source ELVSS via an organic light emitting diode (OLED).

Figure 3:
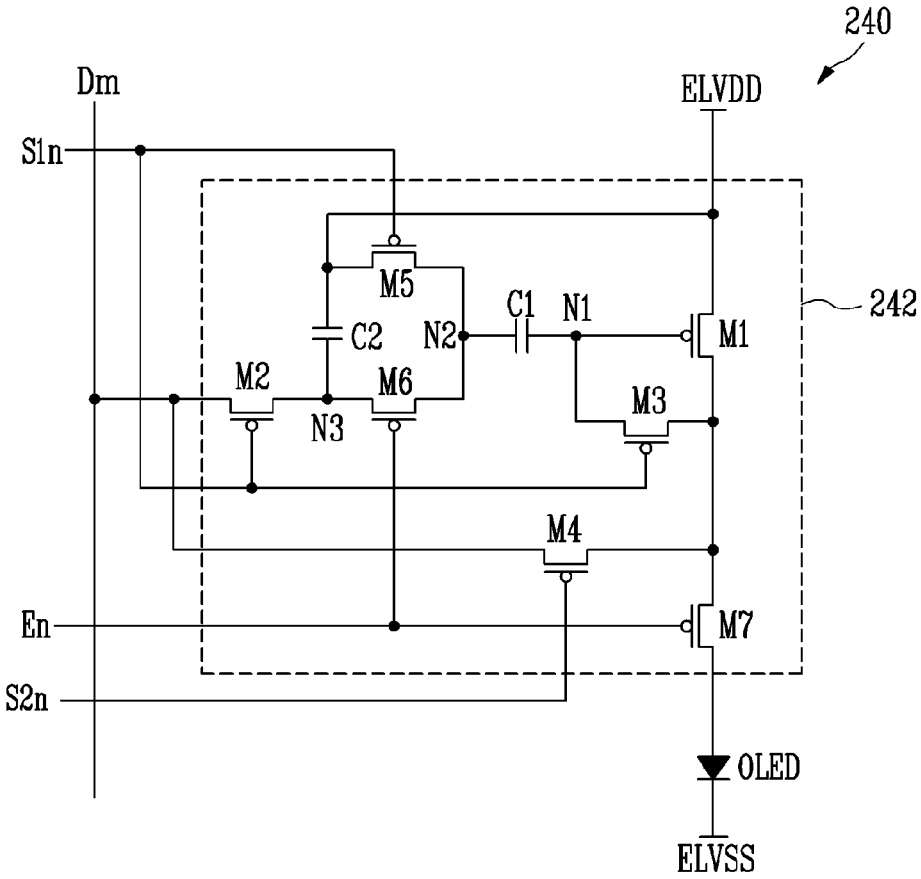
FIG. 3 is a circuit diagram illustrating an embodiment of the pixel of FIG. 2.

FIG. 3 is a circuit diagram illustrating an embodiment of the pixel of FIG. 2. In FIG. 3, for convenience sake, a pixel coupled to the n1st scan line S1*n* and the mth data line Dm will be illustrated. Referring to FIG. 3, the pixel 240 includes a pixel circuit 242 coupled to the OLED, the first scan line S1*n*, the second scan line S2*n*, the emission control line En, and the data line Dm to control the amount of current supplied to the OLED.

The anode electrode of the OLED is coupled to the pixel circuit 242 and the cathode electrode of the OLED is coupled to the second power source ELVSS. The OLED generates light with predetermined brightness to correspond to the current supplied from the pixel circuit 242.

The pixel circuit 242 controls the amount of current supplied from the first power source ELVDD to the second power source ELVSS via the OLED to correspond to the data signal. Therefore, the pixel circuit 242 includes first to seventh transistors M1 to M7, a first capacitor C1, and a second capacitor C2.

The first electrode of the first transistor M1 is coupled to the first power source ELVDD and the second electrode of the first transistor M1 is coupled to the first electrode of the seventh transistor M7. The gate electrode of the first transistor M1 is coupled to a first node N1. The first transistor M1 controls the amount of current supplied to the OLED to correspond to the voltage applied to the first node N1.

The first electrode of the second transistor M2 is coupled to the data line Dm and the second electrode of the second transistor M2 is coupled to a third node N3. The gate electrode of the second transistor M2 is coupled to the first scan line S1*n*. The second transistor M2 is turned on when the first scan signal is supplied to the first scan line S1*n* to electrically couple the data line Dm and the third node N3 to each other.

The first electrode of the third transistor M3 is coupled to the second electrode of the first transistor M1 and the second electrode of the third transistor M3 is coupled to the first node N1. The gate electrode of the third transistor M3 is coupled to the first scan line S1*n*. The third transistor M3 is turned on when the first scan signal is supplied to the first scan line S1*n* and electrically couples the first node N1 and the second electrode of the first transistor M1 to each other. In this case, the first transistor M1 is in the form of a diode.

The first electrode of the fourth transistor M4 is coupled to the second electrode of the first transistor M1 and the second electrode of the fourth transistor M4 is coupled to the data line Dm. The gate electrode of the fourth transistor M4 is coupled to the second scan line S2*n*. The fourth transistor M4 is turned on when the second scan signal is supplied to the second scan line S2*n* and electrically couples the second electrode of the first transistor M1 and the data line Dm to each other.

The first electrode of the fifth transistor M5 is coupled to the first power source ELVDD and the second electrode of the fifth transistor M5 is coupled to a second node N2. The gate electrode of the fifth transistor M5 is coupled to the first scan line S1*n*. The fifth transistor M5 is turned on when the first scan signal is supplied to the first scan line S1*n* and electrically couples the first power source ELVDD and the second node N2 to each other.

The first electrode of the sixth transistor M6 is coupled to a third node N3 and the second electrode of the sixth transistor M6 is coupled to the second node N2. The gate electrode of the sixth transistor M6 is coupled to the emission control line En. The sixth transistor M6 is turned off when the emission control signal is supplied to the emission control line En to block electrical coupling between the second node N2 and the third node N3.

The first electrode of the seventh transistor M7 is coupled to the second electrode of the first transistor M1 and the second electrode of the seventh transistor M7 is coupled to the anode electrode of the OLED. The gate electrode of the seventh transistor M7 is coupled to the emission control line En. The seventh transistor M7 is turned off when the emission control signal is supplied to the emission control line En to electrically block the second electrode of the first transistor M1 and the anode electrode of the OLED from each other.

The first capacitor C1 is coupled between the first node N1 and the second node N2. The first capacitor C1 charges with the voltage corresponding to the threshold voltage of the first transistor M1.

The second capacitor C2 is coupled between the third node N3 and the first power source ELVDD. The second capacitor C2 charges with the voltage corresponding to the data signal.

Figure 4:
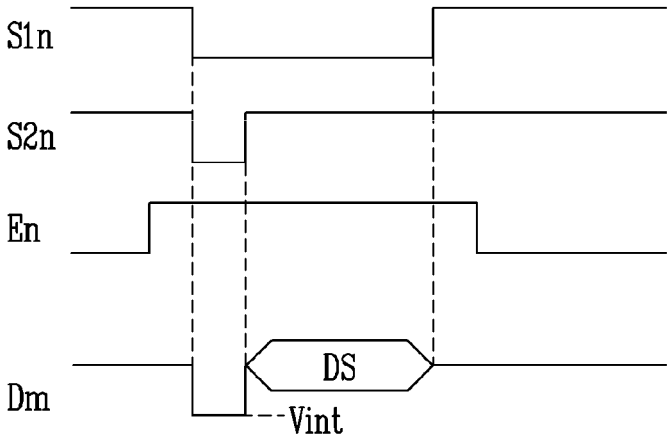
FIG. 4 is a waveform chart illustrating a method of driving the pixel of FIG. 3.

FIG. 4 is a waveform chart illustrating a method of driving the pixel of FIG. 3. Referring to FIG. 4, the emission control signal is supplied to the emission control line En so that the sixth transistor M6 and the seventh transistor M7 are turned off. When the sixth transistor M6 is turned off, the second node N2 and the third node N3 are electrically blocked from each other. When the seventh transistor M7 is turned off, the OLED and the first transistor M1 are electrically blocked from each other.

Then, the moment when the first scan signal is supplied to the first scan line S1*n*, the second scan signal is supplied to the second scan line S2*n*. An initial power source Vint is supplied to the data line Dm in synchronization with the second scan signal supplied to the second scan line S2*n*. Here, the initial power source Vint is set as a voltage lower than the voltage obtained by subtracting the threshold voltage of the first transistor M1 from the first power source ELVDD.

When the first scan signal is supplied to the first scan line S1*n*, the second transistor M2, the third transistor M3, and the fifth transistor M5 are turned on.

When the second transistor M2 is turned on, the third node N3 and the data line Dm are electrically coupled to each other. Then, the voltage of the initial power source Vint from the data line Dm is supplied to the third node N3.

When the third transistor M3 is turned on, the first node N1 and the first electrode of the fourth transistor M4 are electrically coupled to each other. When the fifth transistor M5 is turned on, the voltage of the first power source ELVDD is supplied to the second node N2.

When the second scan signal is supplied to the second scan line S2*n*, the fourth transistor M4 is turned on. When the fourth transistor M4 is turned on, the data line Dm and the first electrode of the third transistor M3 are electrically coupled to each other. Here, since the third transistor M3 is set to be turned on, the voltage of the initial power source Vint from the data line Dm is supplied to the first node N1. At this time, the voltage of the first node N1 is initialized to the voltage of the initial power source Vint.

Then, supply of the second scan signal to the second scan line S2*n* is stopped and the data signal is supplied to the data line Dm. Here, since the first scan signal is set to have a larger width than the second scan signal, the second transistor M2, the third transistor M3, and the fifth transistor M5 remain on a turn on state.

When the fifth transistor M5 maintains the turn on state, the voltage of the first power source ELVDD is supplied to the second node N2.

When the second transistor M2 maintains a turn on state, the data signal from the data line Dm is supplied to the third node N3 via the second transistor M2. At this time, the second capacitor C2 charges the voltage corresponding to the data signal.

When the third transistor M3 is turned on, the first transistor M1 is coupled in the form of a diode. When the first transistor M1 is coupled in the form of a diode, the voltage of the first node N1 increases to the voltage obtained by subtracting the threshold voltage of the first transistor M1 from the first power source ELVDD. At this time, the first capacitor C1 charges with the voltage corresponding to the threshold voltage of the first transistor M1.

Then, supply of the first scan signal to the first scan line S1*n* is stopped so that the second transistor M2, the third transistor M3, and the fifth transistor M5 are turned off. In addition, supply of the emission control signal to the emission control line En is stopped so that the sixth transistor M6 and the seventh transistor M7 are turned on.

When the seventh transistor M7 is turned on, the second electrode of the first transistor M1 and the OLED are electrically coupled to each other. When the sixth transistor M6 is turned on, the third node N3 and the second node N2 are electrically coupled to each other. In this case, the voltage charged to the first capacitor C1 and the second capacitor C2, that is, the voltage corresponding to the data signal and the threshold voltage of the first transistor M1 is applied to the first node N1. The first transistor M1 controls the amount of current that flows from the first power source ELVDD to the second power source ELVSS via the OLED to correspond to the voltage applied to the first node N1.

In the above-described pixel, the first node N1 is initialized using the initial power source Vint supplied to the data line Dm. In this case, a wiring line for coupling the initial power source Vint and the pixel circuit 242 to each other is removed.

On the other hand, in the organic light emitting display illustrated in FIG. 2, the data lines D1 to Dm are directly coupled to the data driver 200. However, the aspects of the present invention are not limited to the above.

Figure 5:
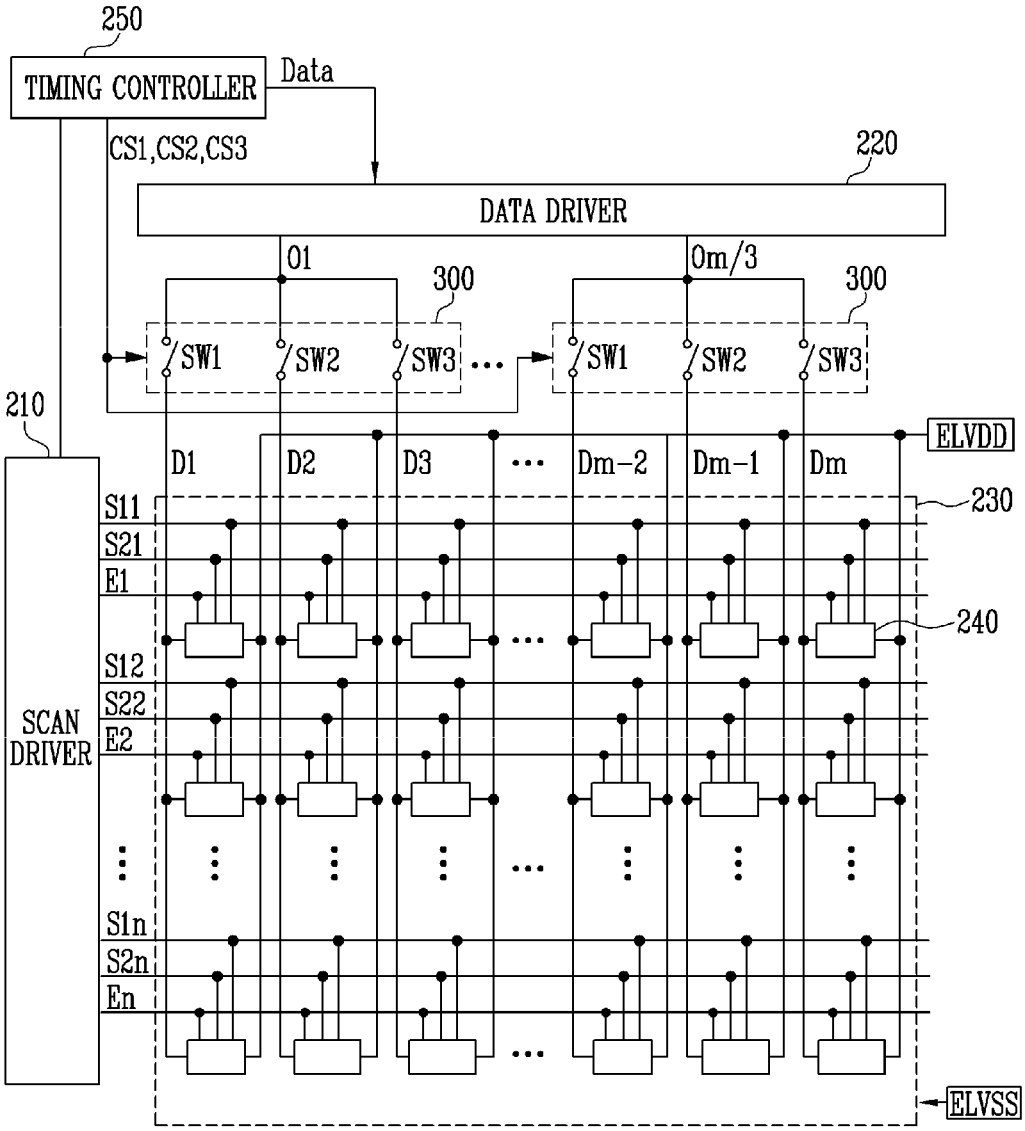
FIG. 5 is a view illustrating an organic light emitting display according to another embodiment of the present invention.

FIG. 5 is a view illustrating an organic light emitting display according to another embodiment of the present invention. In FIG. 5, the same elements as those of FIG. 2 are denoted by the same reference numerals and detailed description thereof will be omitted.

Referring to FIG. 5, the organic light emitting display according to another embodiment of the present invention additionally includes a demultiplexer 300 (hereinafter, referred to as a demux). The demux 300 transmits j (j is a natural number) data signals supplied to output lines O1 to Om/3 to j data lines.

Therefore, the demux 300 includes j switching elements SW1 to SW3. Then, for convenience sake, it is assumed that j is 3 and description will be made using the demux 300 coupled to the first output line O1. However, the aspects of the present invention are not limited thereto and the demux 300 may include more or less switching elements.

The first switching element SW1 is turned on when a first control signal CS1 is supplied from the timing controller 250 to electrically couple the output line O1 and the first data line D1 to each other. The second switching element SW2 is turned on when a second control signal CS2 is supplied from the timing controller 250 to electrically couple the output line O1 and the second data line D2 to each other. The third switching element SW3 is turned on when a third control signal CS3 is supplied to electrically couple the output line O1 and the third data line D3 to each other.

Figure 6:
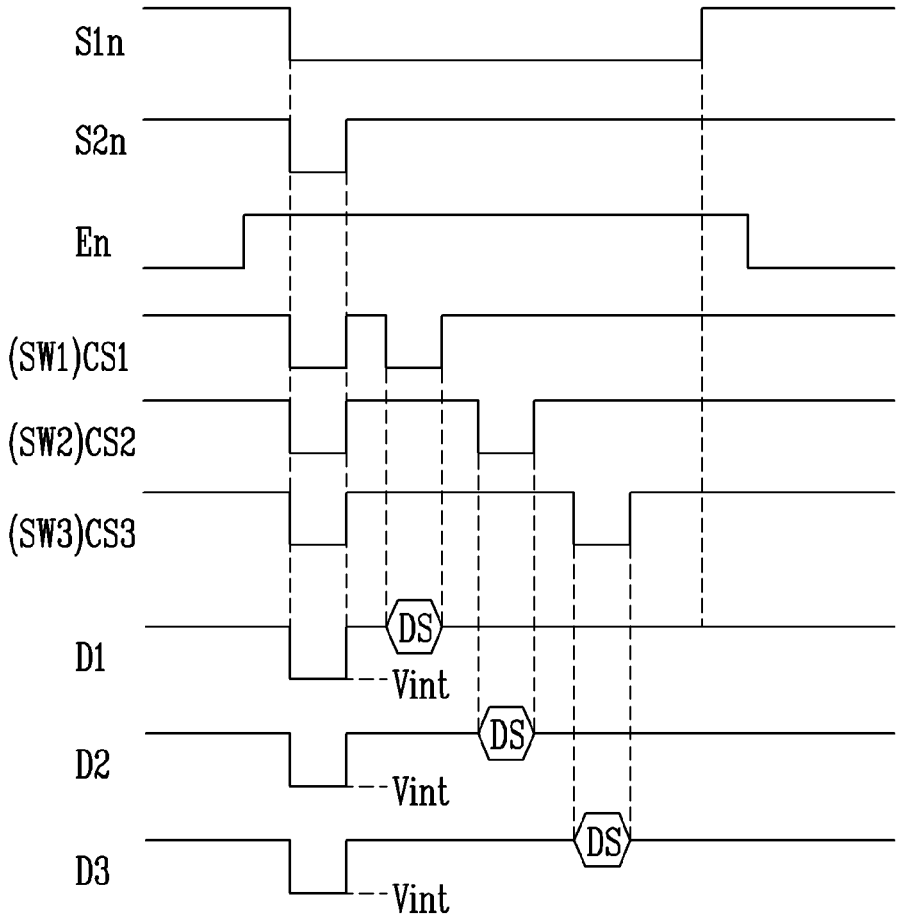
FIG. 6 is a waveform chart illustrating a method of driving the organic light emitting display of FIG. 5.

FIG. 6 is a waveform chart illustrating a method of driving the organic light emitting display of FIG. 5.

When operation processes are described with reference to FIGS. 3, 5, and 6, first, the emission control signal is supplied to the emission control line En so that the sixth transistor M6 and the seventh transistor M7 included in each of the pixels 240 are turned off.

Then, the moment when the first scan signal is supplied to the first scan line S1*n*, the second scan signal is supplied to the second scan line S2*n*. Also, the first to third control signals CS1 to CS3 are supplied in synchronization with the scan signal supplied to the second scan line S2*n* and the initial power source Vint is supplied to the output line O1.

When the first to third control signals CS1 to CS3 are supplied, the first to third switching elements SW1 to SW3 are turned on. In this case, the voltage of the initial power source Vint is supplied to the data lines D1 to Dm. When the initial power source Vint is supplied to the data lines D1 to Dm, the first node N1 of each of the pixels 140 coupled to the second scan line S2*n* is initialized to the voltage of the initial power source Vint.

Then, in a period when supply of the second scan signal to the second scan line S2*n* is stopped and the first scan signal is supplied to the first scan line S1*n*, the first control signal CS1, the second control signal CS2, and the third control signal CS3 are sequentially supplied.

When the first control signal CS1 is supplied, the first switching element SW1 is turned on so that the data signals supplied to the output lines O1 to Om are supplied to the data lines D1, D4, . . . . At this time, the voltages corresponding to the data signals are charged in the second capacitors C2 of the pixels 140 coupled to the data lines D1, D4, . . . and the first scan lines S1*n*.

When the second control signal CS2 is supplied, the second switching element SW2 is turned on so that the data signals supplied to the output lines O1 to Om are supplied to the data lines D2, D5, . . . . At this time, the voltages corresponding to the data signals are charged in the second capacitors C2 of the pixels 140 coupled to the data lines D2, D5, . . . and the first scan lines S1*n*.

When the third control signal CS3 is supplied, the third switching element SW3 is turned on so that the data signals supplied to the output lines O1 to Om are supplied to the data lines D3, D6, . . . . At this time, the voltages corresponding to the data signals are charged in the second capacitors C2 of the pixels 140 coupled to the data lines D3, D6, . . . and the first scan lines S1*n*.

On the other hand, in a period when the first to third control signals CS1 to CS3 are sequentially supplied, the voltage corresponding to the threshold voltage of the first transistor M1 is applied to the first node N1 of each of the pixels 140 coupled to the first scan lines S1*n*. In this case, the threshold voltage of the first transistor M1 may be compensated for a time longer than the period when the control signals CS1 to CS3 are supplied.

After the voltage corresponding to the data signal is charged to the second capacitor C2 of each of the pixels, supply of the emission control signal to the emission control line En is stopped. When the supply of the emission control signal to the emission control line En is stopped, the first transistor M1 of each of the pixels 140 coupled to the emission control line En is electrically coupled to the OLED. In this case, the first transistor M1 supplies the current corresponding to the voltage applied to the first node N1 to the OLED so that light with predetermined brightness is generated.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A pixel comprising:

an organic light emitting diode (OLED);

a first transistor to control an amount of current supplied from a first power source coupled to a first electrode to the OLED;

a second transistor coupled between a data line and a third node, the second transistor to be turned on when a first scan signal is supplied to a first scan line;

a first capacitor coupled between a first node and a gate electrode of the first transistor and a second node;

a sixth transistor coupled between the second node and the third node, the sixth transistor to be turned off when an emission control signal is supplied to an emission control line;

a second capacitor coupled between the third node and the first power source;

a fifth transistor coupled between the first power source and the second node, the fifth transistor to be turned on when the first scan signal is supplied to the first scan line; and a fourth transistor coupled between a second electrode of the first transistor and the data line, the fourth transistor to be turned on when a second scan signal is supplied to a second scan line, wherein the second transistor is simultaneously turned on with the fourth transistor and maintains a turn on state for a period of time longer than the fourth transistor.

2. The pixel as claimed in claim 1, wherein a turn on time of the sixth transistor does not overlap with a turn on time of the second transistor and the fourth transistor.

3. The pixel as claimed in claim 1, further comprising:

a third transistor coupled between the second electrode and the gate electrode of the first transistor, the third transistor to be turned on when the first scan signal is supplied to the first scan line; and a seventh transistor coupled between the second electrode of the first transistor and the OLED, the seventh transistor to be turned off when the emission control signal is supplied to the emission control line.

* * * * *